US010618705B1

(12) United States Patent
Laible

(10) Patent No.: US 10,618,705 B1
(45) Date of Patent: Apr. 14, 2020

(54) DUAL DRAW CAP ADAPTER

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 16/682,625

(22) Filed: Nov. 13, 2019

(51) Int. Cl.

| | |
|---|---|
| ***B65D 47/12*** | (2006.01) |
| ***B05B 1/14*** | (2006.01) |
| ***B05B 15/30*** | (2018.01) |
| *B05B 12/00* | (2018.01) |
| *B65D 41/04* | (2006.01) |
| *B65D 47/32* | (2006.01) |

(52) U.S. Cl.
CPC ..... *B65D 47/123* (2013.01); *B05B 1/14* (2013.01); *B05B 15/30* (2018.02); *B05B 12/004* (2013.01); *B65D 41/0492* (2013.01); *B65D 47/32* (2013.01)

(58) Field of Classification Search
CPC ..... B65D 47/32; B65D 47/2012; B65D 47/2018; B65D 47/2037; B65D 47/2043; B65D 47/205; B65D 47/24; B65D 47/241; B65D 47/242; B65D 47/26; B65D 47/261; B65D 47/263; B65D 47/266; B65D 47/283; B65D 47/28; B65D 47/123; B05B 15/30; B05B 1/14
See application file for complete search history.

(56) References Cited

U.S. PATENT DOCUMENTS

| | | | | |
|---|---|---|---|---|
| 1,375,030 | A * | 4/1921 | Watkins | B65D 47/283 222/482 |
| 5,108,015 | A * | 4/1992 | Rauworth | B67D 1/0835 137/212 |
| 5,472,119 | A * | 12/1995 | Park | B05B 11/3081 222/136 |
| 6,619,318 | B2 * | 9/2003 | Dalhart | B01F 3/0865 137/565.22 |
| 6,659,311 | B2 * | 12/2003 | Prueter | B05B 11/3081 222/136 |
| 6,669,062 | B1 * | 12/2003 | Laible | B67D 7/0294 141/244 |
| 7,237,728 | B1 | 7/2007 | Laible | |
| 7,407,117 | B2 * | 8/2008 | Dodd | B05B 7/2443 222/145.8 |
| 9,458,003 | B1 * | 10/2016 | Laible | B67D 7/0266 |
| 2012/0241474 | A1 * | 9/2012 | Dennis | B05B 15/30 222/137 |
| 2016/0185494 | A1 * | 6/2016 | Sasturain | B65D 43/0277 222/1 |

* cited by examiner

*Primary Examiner* — Patrick M. Buechner
(74) *Attorney, Agent, or Firm* — Dennis L. Thomte; Thomte Patent Law Office LLC

(57) ABSTRACT

A dual draw cap adapter for mounting on the upper end of a liquid chemical container with the throat of the container having a dual draw container insert positioned therein. The adapter cap includes top and bottom housings which are joined together. The bottom housing has first and second fluid passageways extending therethrough. The top housing also has first and second fluid passageways extending therethrough which communicate with the first and second fluid passageways in the bottom housing. The first and second fluid passageways in the bottom housing are in fluid communication with a pair of flow channels in the container insert. A pair of take-off supports and take-offs are mounted on the upper end of the top housing.

6 Claims, 7 Drawing Sheets

DUAL DRAW CAP ADAPTER

BACKGROUND OF THE INVENTION

Field of the Invention

This invention relates to an adapter cap which is used in conjunction with a dual draw straw stick container insert which has first and second separate flow channels formed therein. More particularly, this invention relates to an adapter cap which has first and second fluid passageways extending therethrough which communicate with the first and second flow channels of the container insert.

Description of the Related Art

Applicant's U.S. Pat. No. 9,458,003 discloses a multi-port cap adapter for a liquid dispensing system. Although the cap adapter of the '003 Patent discloses two take-off ports or members 64 and 64', the cap adapter of the '003 Patent has only a single fluid passageway in communication with those two ports. The cap adapter of the '003 Patent is not designed to dispense two different dilutions. Applicant's co-pending U.S. patent application Ser. No. 16/682,562 entitled DUAL DRAW STICK CONTAINER INSERT discloses a container insert which has two separate flow channels formed therein which communicate with draw sticks positioned in a container and which supply two different chemical dilutions to the container insert. Thus, since the adapter cap of the '003 patent has only a single fluid passageway formed therein, the adapter cap of the '003 patent cannot be used with the container insert of the co-pending application.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A dual draw cap adapter is disclosed for mounting on the outlet opening of a liquid container. The dual draw cap adapter includes a cylindrical cap having a top wall with an internally threaded side wall extending downwardly therefrom with the top wall of the cap having a circular opening formed therein. The cylindrical cap is configured to be secured to the container at the outlet opening thereof. The cap adapter of this invention includes top and bottom housings having upper and lower ends with the top housing having a cylindrical body member having an upper end, a lower end, an inner surface and an outer surface. The lower end of the body member of the top housing has external threads formed therein. The body member of the top housing has a diameter which is less than the diameter of the circular opening in the top wall of the cylindrical cap with the top housing including a horizontally disposed support wall, having upper and lower ends, below the upper end of the body member of the top housing. The support wall has a diameter which is greater than the diameter of the circular opening in the top wall of the cylindrical cap. The lower end of the support wall is positioned on the top wall of the cylindrical cap with the lower end of the body member of the top housing extending downwardly through the circular opening in the top wall of the cap.

The cap adapter of this invention also includes a first take-off support, having an upper end and a lower end, which is integrally formed with the support wall and which extends upwardly therefrom. The first take-off support has a cylindrical first bore, having upper and lower ends, which extends downwardly thereinto. The lower end of the first bore is in fluid communication with a first fluid opening in the support wall. A flexible first one-way valve is positioned in the first bore of the first take-off support. The cap adapter also includes a second take-off support, having an upper end and a lower end, which is integrally formed with the support wall and which extends upwardly therefrom. The second take-off support has a cylindrical first bore, having upper and lower ends, which extends downwardly thereinto. The lower end of the first bore of the second take-off support is in fluid communication with a second fluid opening in the support wall. A flexible second one-way valve is positioned in the first bore of the second take-off support. The one-way valves are normally closed but will open when subjected to suction pressure.

A hollow take-off port is mounted on the first take-off support and a hollow second take-off port is mounted on the second take-off support. The top housing has a first fluid passageway formed therein which has upper and lower ends. The upper end of the first fluid passageway in the top housing is in communication with the first valve and the first take-off port. The top housing also has a second fluid passageway formed therein which has upper and lower ends. The upper end of the second fluid passageway in the top housing is in communication with the second valve and the second take-off port.

The bottom housing of the cap adapter has upper and lower ends with the bottom housing having internal threads which are threadably connected to the external threads of the top housing. The bottom housing has a first fluid passageway formed therein which has upper and lower ends. The lower end of the first fluid passageway in the bottom housing is in communication with the upper end of the first flow channel in the container insert. The lower end of the second fluid passageway in the bottom housing is in fluid communication with the upper end of the second flow channel in the container insert. The upper end of the first fluid passageway in the bottom housing is in communication with the lower end of the first fluid passageway in the top housing. The upper end of the second fluid passageway in the bottom housing is in communication with the lower end of the second fluid passageway in the top housing.

Thus, a first dilution may pass from the upper end of the first flow channel in the container insert, through the first fluid passageway in the bottom housing, through the first fluid passageway in the top housing, through the first take-off support and the first valve and upwardly through the first take-off port. Further, a second dilution may pass from the upper end of the second flow channel in the container insert, through the second fluid passageway in the bottom housing, through the second fluid passageway in the top housing, through the second take-off support and the second valve and upwardly through the second take-off port.

A principal object of the invention is to provide a dual draw cap adapter.

A further object of the invention is to provide a dual draw cap adapter which may be used with a dual draw straw stick container insert.

Yet another object of the invention is to provide a dual draw cap adapter which has separate first and second fluid passageways extending therethrough.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
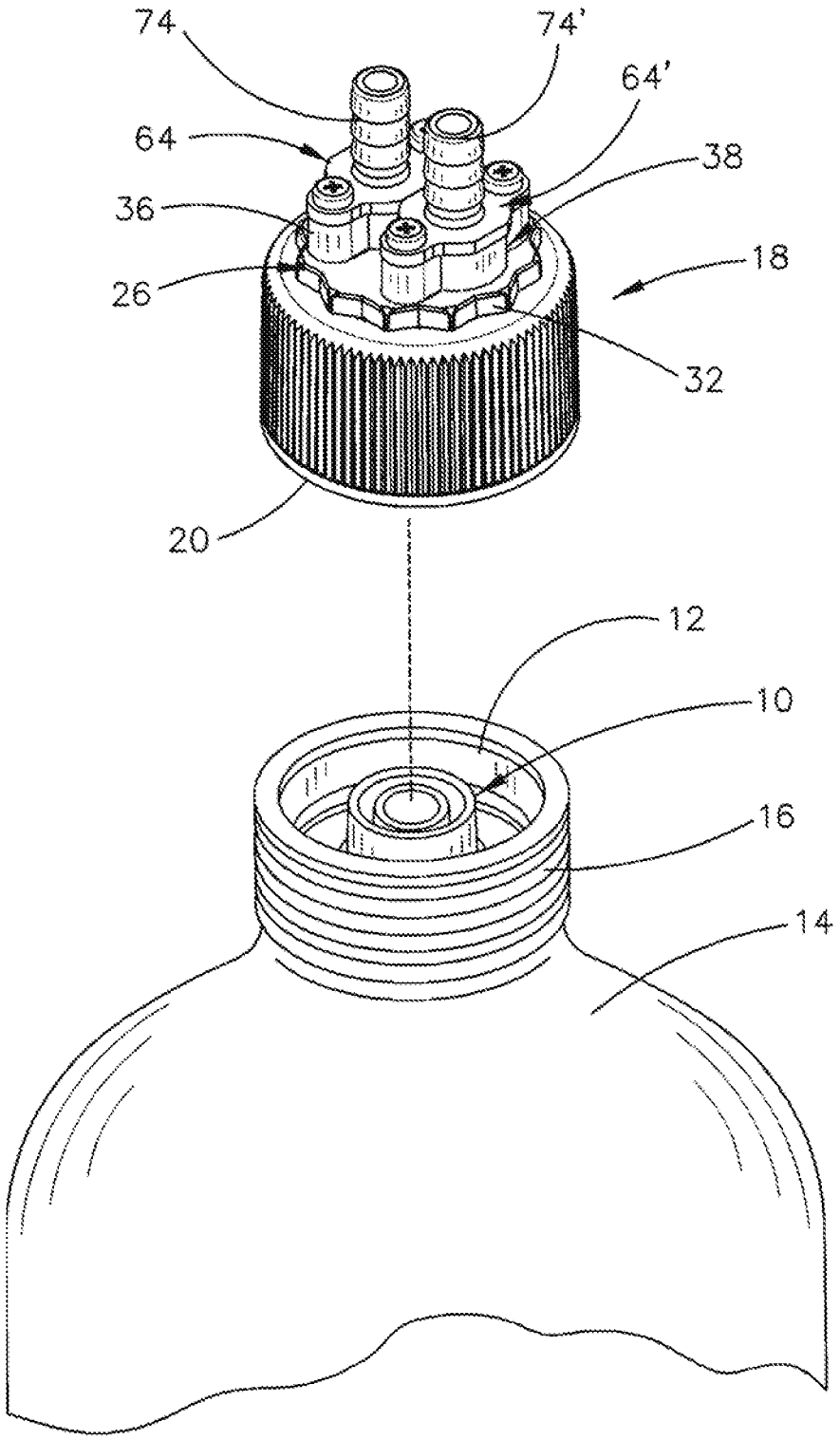
FIG. 1 is an exploded perspective view of the cap adapter of this invention which may be mounted on the container illustrated in FIG. 1.
Figure 2:
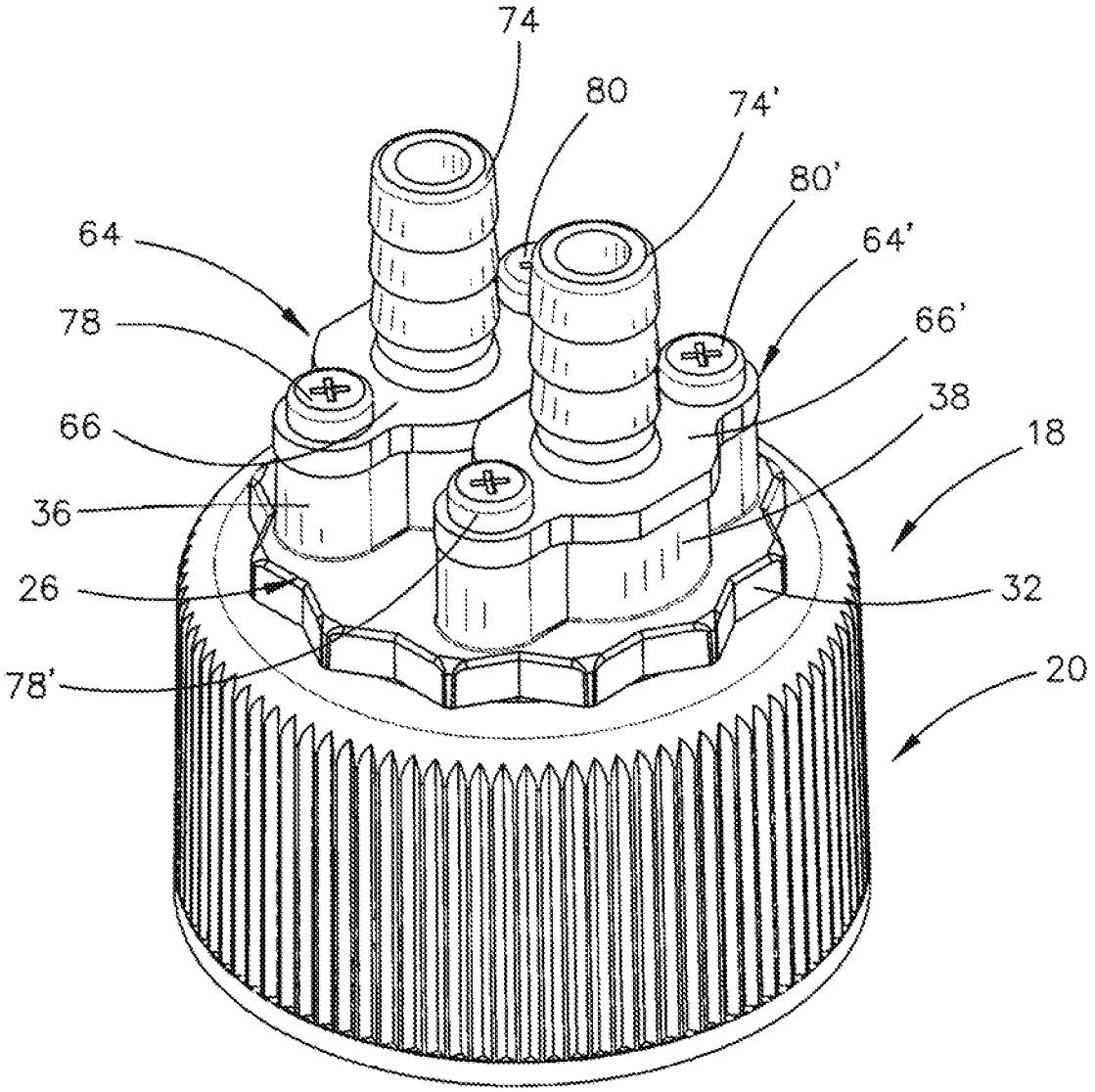
FIG. 2 is an upper perspective view of the cap adapter of this invention.
Figure 3:
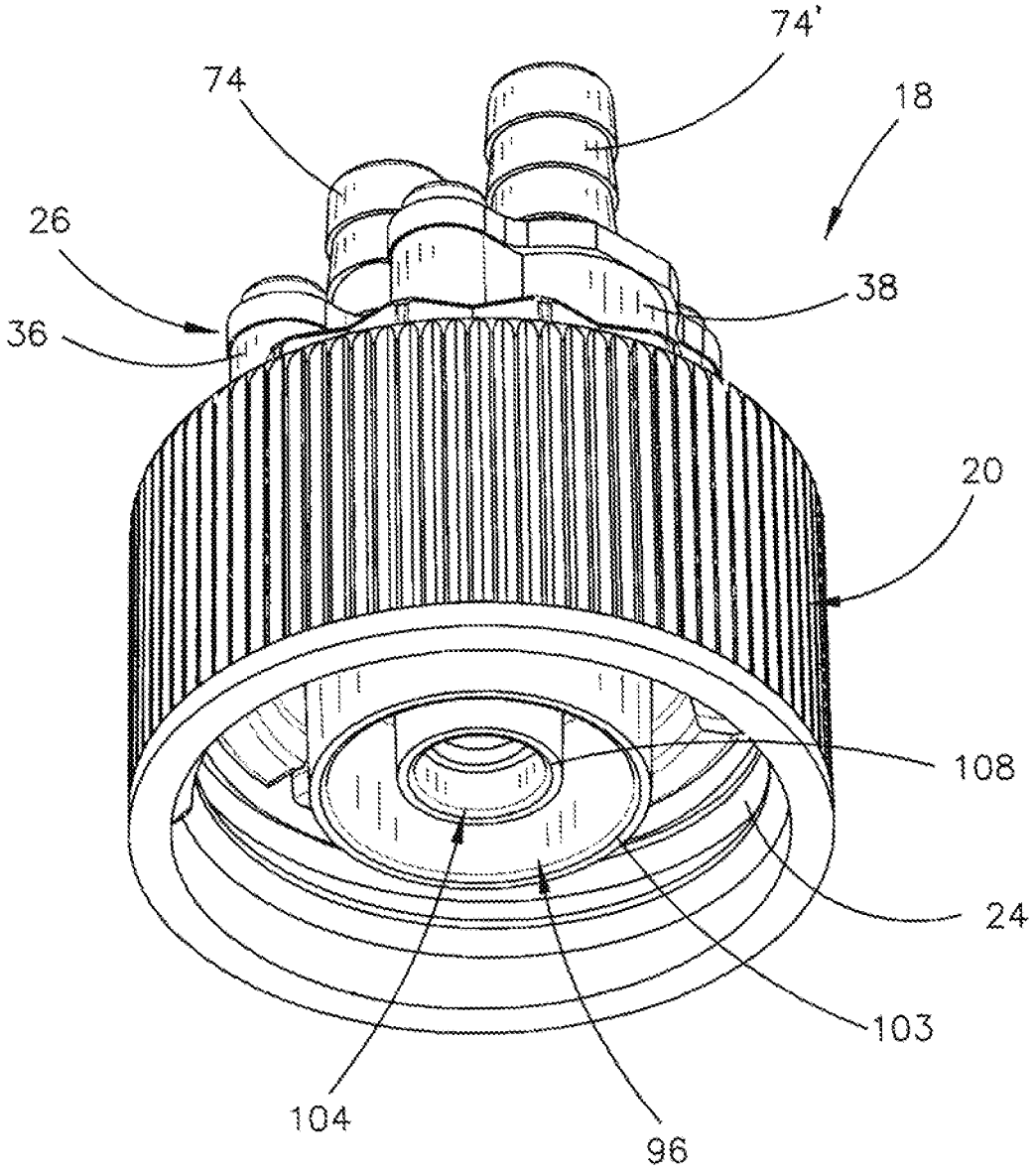
FIG. 3 is a lower perspective view of the cap adapter of this invention.
Figure 4:
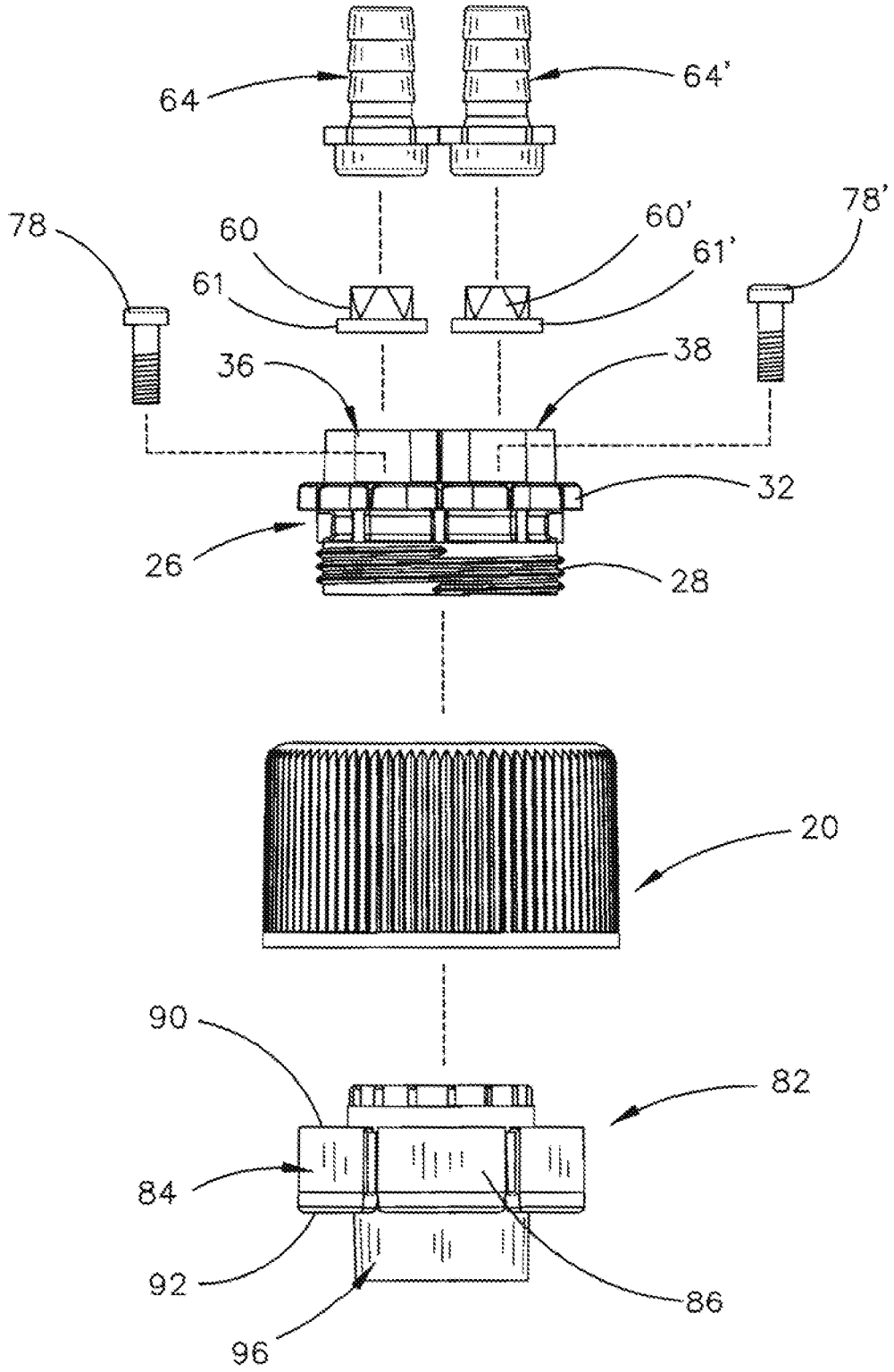
FIG. 4 is an exploded side view of the cap adapter of this invention.
Figure 5:
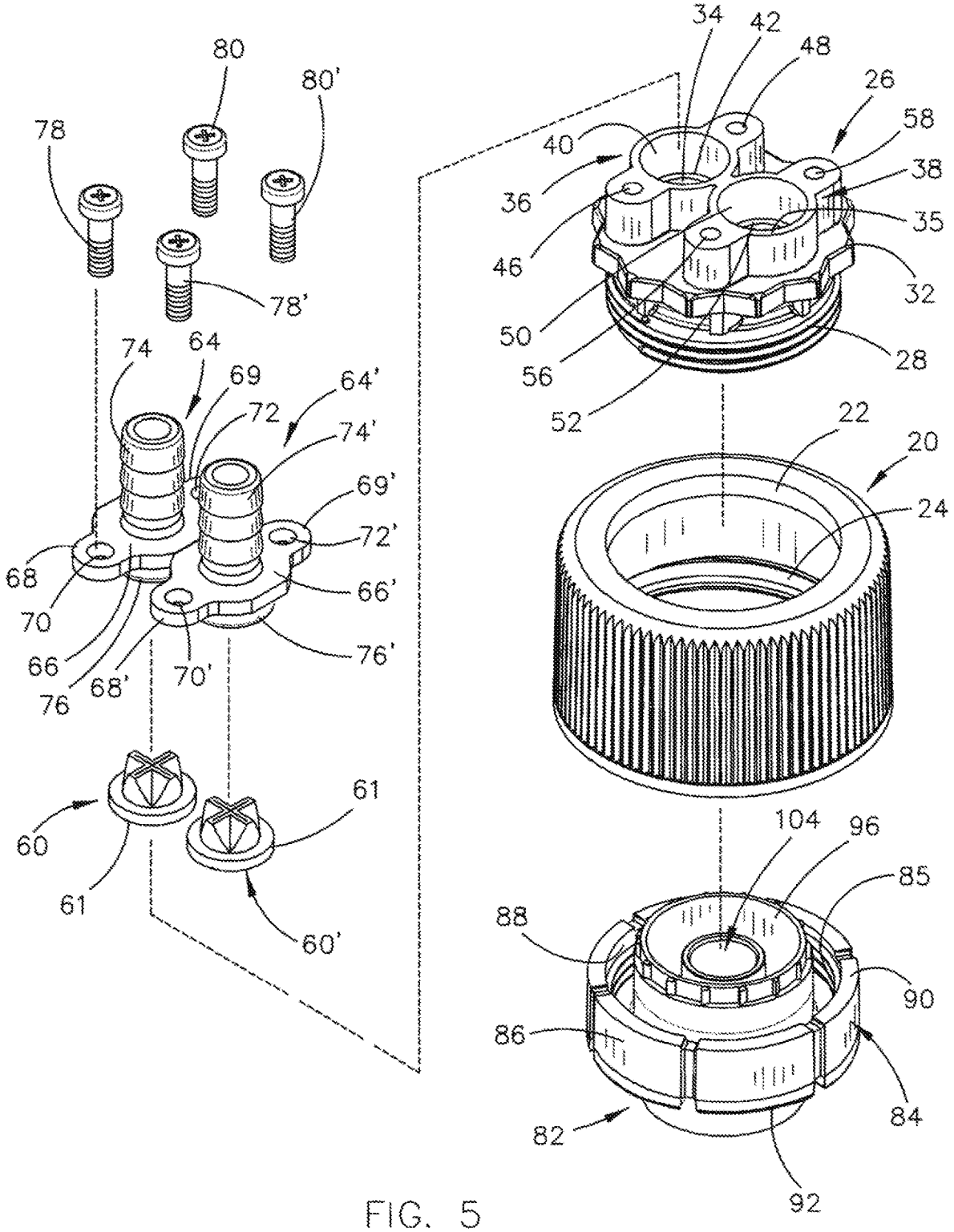
FIG. 5 is an exploded perspective view of the cap adapter of this invention.
Figure 6:
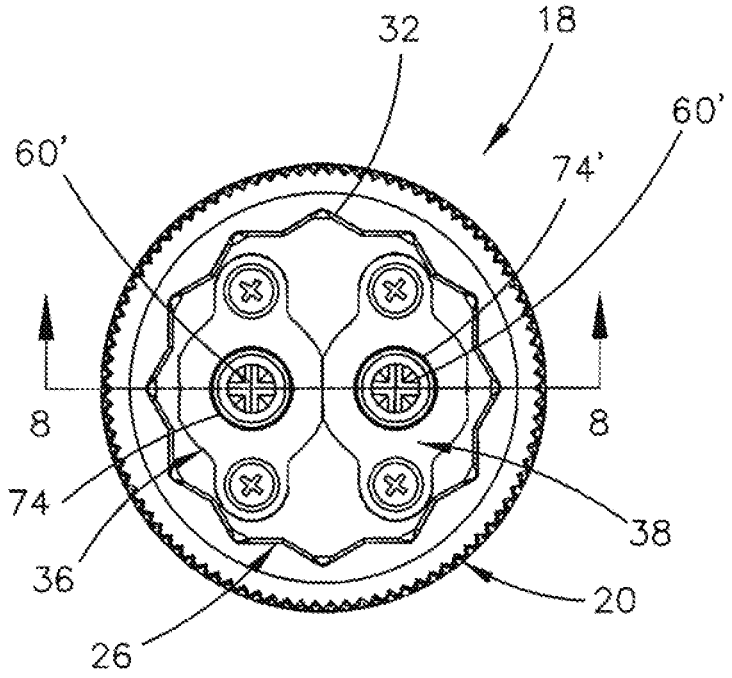
FIG. 6 is a top view of the cap adapter of this invention.
Figure 7:
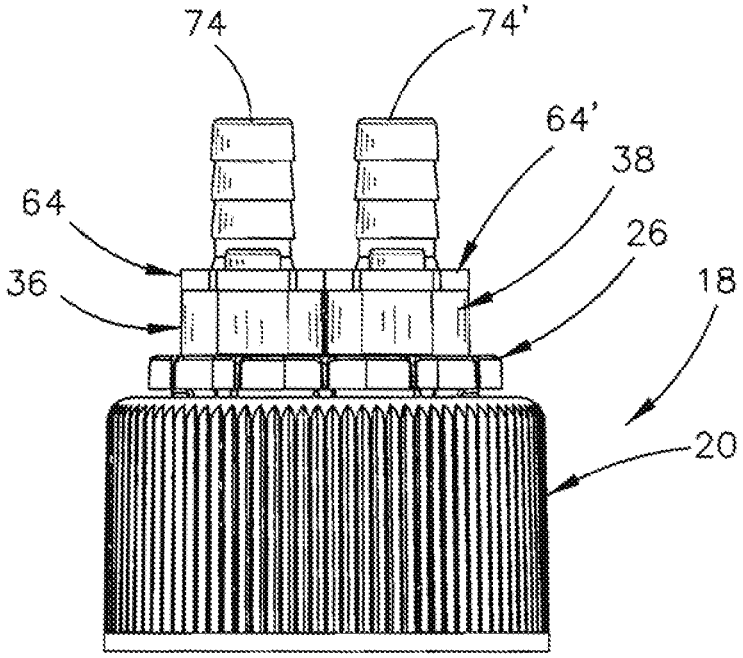
FIG. 7 is a side view of the cap adapter of this invention.
Figure 8:
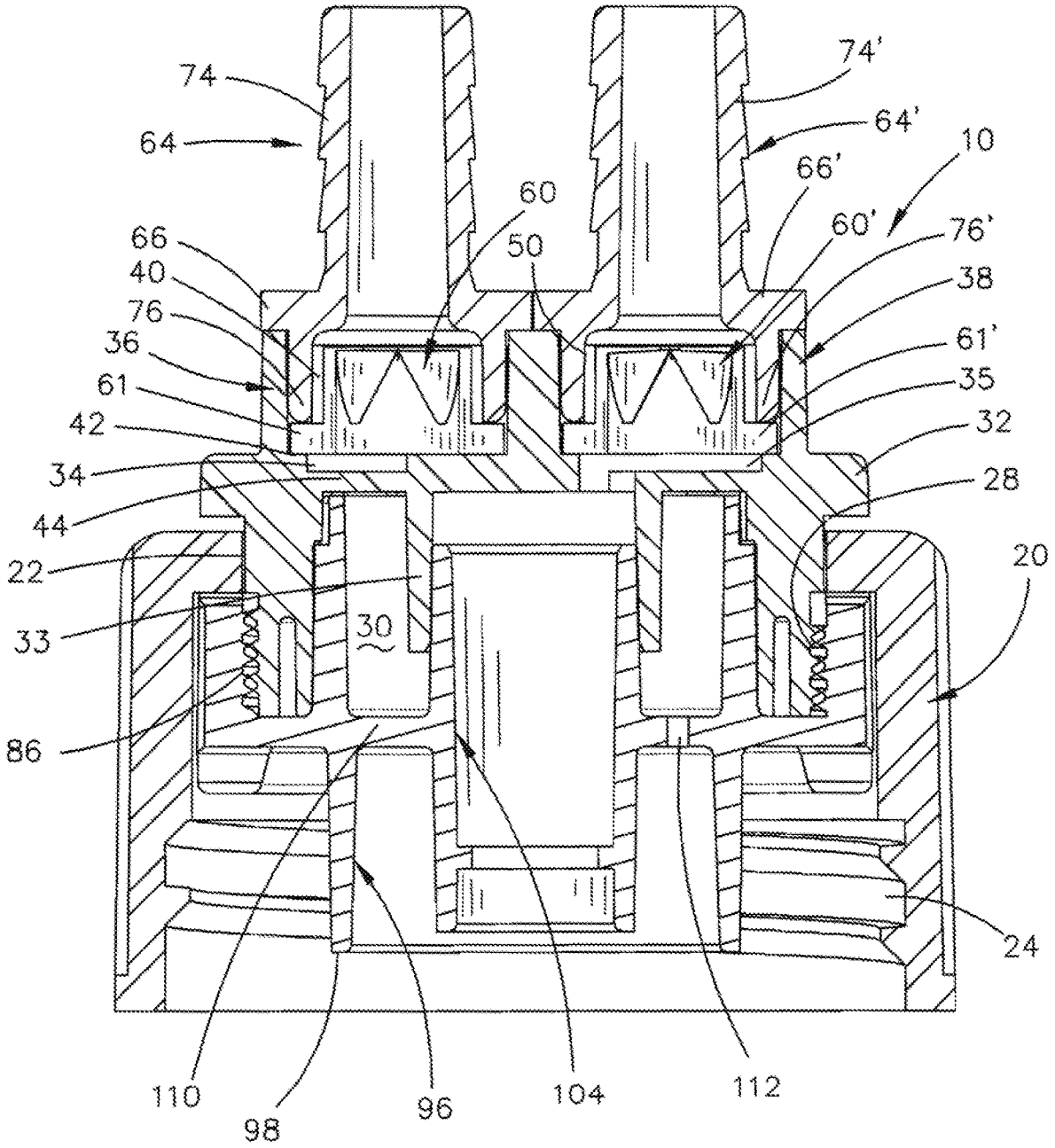
FIG. 8 is a sectional view of the cap adapter of this invention as seen on lines 8-8 of FIG. 6.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

In the drawings, the numeral 10 refers to a container insert which is press-fitted into the throat or outlet opening 12 of a container 14 such as a bottle or the like. Preferably, throat 12 includes external threads 16. The container insert 10 is of the type disclosed in the co-pending U.S. patent application Ser. No. 16/682,562 which is entitled DUAL DRAW STICK CONTAINER INSERT. The container insert of the co-pending application is configured to provide first and second separate flow channels extending therethrough.

The numeral 18 refers to the cap adapter of this invention which is configured to be threadably mounted on throat 12 of the container 14 to supply liquid to at least a pair of draw-off mechanisms, such as dispensers, mixing machines, etc. The cap adapter 18 is configured to be compatible with the container insert of the co-pending application to communicate with the two flow channels of the co-pending application. Cap adapter 18 includes a cap or collar 20 having an upper opening 22 formed therein. Cap 20 has internal threads 24 formed therein at its lower open end.

The numeral 26 refers to an upper or top housing having an externally threaded cylindrical portion 28 at its lower end. Top housing 26 has a central opening or passageway 30 extending upwardly thereinto from its lower end. Housing 26 includes a horizontally disposed wall or support 32 which has a greater diameter than the threaded portion 28 of housing 26 and which has a greater diameter than opening 22 of cap 20. Housing 26 includes a tubular member 33 which extends downwardly from support 32. Wall 32 has a pair of spaced-apart openings 34 and 35 formed therein. The upper end of tubular member 33 communicates with opening 35. A pair of take-off supports 36 and 38 are molded with wall 32 and extend upwardly therefrom. Take-off support 36 has an opening or bore 40 extending downwardly thereinto, the lower end of which communicates with opening 34 in wall 32. The lower end of bore 40 has an inwardly protruding annular lip or shoulder 42 and a support bar 44 extending thereacross. A pair of spaced-apart screw openings 46 and 48 extend downwardly into the upper outer ends of take-off support 36. Support 38 has a bore 50 extending downwardly thereinto, the lower end of which communicates with opening 35 in wall 32. The lower end of bore 50 has an inwardly protruding annular lip or shoulder 52 and a support 54 partially closing opening 35. A pair of spaced-apart screw openings 56 and 58 extend downwardly into the upper outer ends of take-off support 38.

A flexible and normally closed valve 60 having a lower flange 61 is positioned in bore 40 with the flange 61 thereof resting on lip 42 and support bar 44. A flexible and normally closed valve 60' having a lower flange 61' is positioned in bore 50 of take-off support 38 with its lower end resting on lip 52 and support 54. Valves 60 and 60' are one-way valves which will open, when subjected to suction, to permit liquid to pass upwardly therethrough. Valves 60 and 60' are identical.

The numerals 64 and 64' designate take-off ports or members which are mounted on take-off supports 36 and 38 respectively. Port 64 includes a flange 66 having ends 68 and 69 which have screw openings 70 and 72 formed therein respectively.

An exteriorly barbed hollow tube 74 extends upwardly from flange 66. Flange 66 has a hollow tubular portion 76 extending downwardly therefrom. The interiors of tube 74 and tubular member 76 communicate with one another to permit liquid to flow therethrough. Tubular portion 76 is inserted downwardly into the upper end of bore 40 of take-off support 36. The lower end of tubular portion 76 is in sealing engagement with flange 61. Screw 78 extends downwardly through screw opening 70 in flange 66 into screw opening 46 in take-off support 36. Screw 80 extends downwardly through screw opening 72 in flange 66 into screw opening 48 in take-off support 38.

Inasmuch as port 64' is identical to port 64, only port 64 will be described in detail with "'" designating duplicate structure on port 64'. Port 64' is secured to take-off support 38 in the same manner as port 64 is secured to the take-off support 36 by the screws 78' and 80'.

The threaded portion 28 of upper housing 26 is inserted downwardly through the opening 22 in cap 20 until the wall 32 is resting on the upper end of cap 20. The numeral 82 designates a lower or bottom housing which is inserted upwardly into the lower open end of cap 20. Housing 82 includes a ring-shaped body member 84 having an internally threaded portion 85 which is configured to be threadably secured to the threaded portion 28 of housing 26 to secure housings 26 and 82 together. When secured together, housings 26 and 82 are selectively rotatably with respect to cap 20.

Body member 84 includes an outer side 86, an inner side 88, an upper end 90 and a lower end 92. A horizontally disposed and ring-shaped wall 94 extends inwardly from the inner side 88 of body member 84 above the lower end of body member 84. A vertically disposed hollow tube 96 is positioned at the inner end of wall 94 and is secured thereto.

Tube 96 will be described as having an upper tube portion 98 with an upper end 100 and a lower tube portion 102 with a lower end 103.

A vertically disposed and hollow tube 104, having an upper end 106 and a lower end 108, is positioned within tube 96. A wall 110 extends between tube 104 and tube 96 and has a plurality of spaced-apart openings 112 formed therein. The configuration of lower housing 82 creates two separate fluid passageways within lower housing 82.

When the cap adapter 18 is mounted on the upper end of container 14, the upper end of one of the two flow channels of the container insert 10 will be in sealing engagement with the lower end of tube 104 and the second of the two flow channels of the container insert 10 will be in sealing engagement with the lower end 98 of tube 96.

The liquid chemical being drawn from the upper end of the first flow channel of the container insert will pass upwardly between the outer side of tube 104 and the inner side of tube 96. The liquid chemical will pass upwardly through the openings 112 in wall 110 and into the area between the outer side of tubular member 33 and the inner side of the upper end of tube 104, thence upwardly through opening 34 in wall 32, thence upwardly through the one-way valve 60, which will be opened by suction, thence upwardly and outwardly through the tube 74.

The liquid chemical being drawn from the second flow channel in container insert 10 will be drawn upwardly into the lower end of tube 104. The liquid chemical passing upwardly through tube 104 will be drawn upwardly through the opening 35 in wall 32, thence upwardly through the one way valve 60', which will be opened by suction and thence upwardly and outwardly through tube 74'. As seen, the configuration of the cap adapter 18 is such that two separate fluid passageways extend upwardly therethrough so that two different chemical dilutions may be dispensing from the cap adapter 18.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination:

a liquid container having an outlet opening;

a dual draw container insert mounted in said outlet opening of said liquid container;

a cylindrical cap having a top wall with an internally threaded side wall extending downwardly therefrom;

said top wall of said cap having a circular opening formed therein;

said cap being configured to be secured to the container at the outlet opening thereof;

a dual draw cap adapter mounted on said cap;

said cap adapter including top and bottom housings having upper and lower ends;

said top housing including a cylindrical body member having an upper end, a lower end, an inner surface and an outer surface;

said lower end of said body member of said top housing having external threads formed therein;

said body member of said top housing having first and second fluid passageways, having upper and lower ends, extending therethrough;

said body member of said top housing having a diameter which is less than the diameter of said circular opening in said top wall of said cap;

said top housing including a horizontally disposed support wall, having upper and lower ends, below said upper end of said body member of said top housing;

said support wall having a diameter which is greater than the diameter of said circular opening in said top wall of said cap;

said lower end of said support wall positioned on said top wall of said cap with a portion of said body member of said top housing extending downwardly through said circular opening in said top wall of said cap;

said support wall having spaced-apart first and second fluid openings formed therein which communicate with said upper ends of said first and second fluid passageways respectively;

a first take-off support, having an upper end and a lower end, which is integrally formed with said support wall and which extends upwardly therefrom;

said first take-off support having a cylindrical first bore, having upper and lower ends, which extends downwardly thereinto;

said lower end of said first bore being in fluid communication with said first fluid opening in said support wall;

a flexible first valve positioned in said first bore of said first take-off support;

said first valve being normally closed but movable to an open position when suction is applied thereto;

a second take-off support, having an upper end and a lower end, which is integrally formed with said support wall and which extends upwardly therefrom;

said second take-off support having a cylindrical first bore, having upper and lower ends, which extends downwardly thereinto;

said lower end of said first bore of said second take-off support being in fluid communication with said second fluid opening in said support wall;

a flexible second valve positioned in said first bore of said second take-off support;

said second valve being normally closed but movable to an open position when suction is applied thereto;

a first fluid take-off, having upper and lower ends, selectively removably mounted on said upper end of said first take-off support;

said first fluid take-off having a fluid passageway extending therethrough which is in fluid communication with said first bore above said first valve in said first take-off support;

a second fluid take-off, having upper and lower ends, selectively removably mounted on said upper end of said second take-off support;

said second fluid take-off having a fluid passageway extending therethrough which is in fluid communication with said second bore above said second valve in said second take-off support;

a bottom housing, having an open lower end and an open upper end, positioned within said cap and having a ring-shaped body portion which is threadably secured to said external threads of said body member of said top housing to secure said top housing and said bottom housing to said cap;

said body portion of said bottom housing including a vertically disposed outer tube having an open upper end, an open lower end, an inner side and an outer side;

said body portion of said bottom housing including a vertically disposed inner tube positioned within said outer tube and spaced inwardly therefrom to create a chamber therebetween;

said inner tube including an open upper end, an open lower end, an inner side and an outer side;

a horizontally disposed and ring-shaped wall extending between said inner and outer tubes in said chamber below said upper ends of said inner and outer tubes;

said ring-shaped wall having a plurality of spaced-apart openings formed therein;

said upper end of said outer tube of said bottom housing being in fluid communication with said second opening in said support wall thereby creating a first fluid passageway extending from said open lower end of said bottom housing, through said adapter cap;

said open lower end of said outer tube being configured to be in fluid communication with said container insert;

said chamber between said outer and inner tubes being in fluid communication with said first opening in said support wall thereby creating a second fluid passageway extending from said open lower end of said bottom housing, through said adapter cap; and said chamber being configured to be in fluid communication with said container insert.

2. In combination:

a liquid container having an outlet opening;

a dual draw container insert mounted in said outlet opening of said liquid container;

a cylindrical cap having a top wall with an internally threaded side wall extending downwardly therefrom;

said top wall of said cap having a circular opening formed therein;

said cap being configured to be secured to the container at the outlet opening thereof;

a dual draw cap adapter mounted on said cap;

said cap adapter including top and bottom housings having upper and lower ends;

said bottom housing having first and second fluid passageways, with upper and lower ends, extending therethrough;

said top housing, having first and second fluid passageways with upper and lower ends, extending therethrough;

said upper end of said first fluid passageway in said bottom housing being in fluid communication with said lower end of said first fluid passageway in said top housing; and said upper end of said second fluid passageway in said bottom housing being in fluid communication with said lower end of said second fluid passageway in said top housing.

3. The cap adapter of claim 2 wherein said lower ends of said first and second passageways in said bottom housing are configured to be placed in fluid communication with said container insert.

4. A cap adapter for use with a liquid container having an outlet opening with a dual draw container insert mounted in the outlet opening of the liquid container, comprising:

a cylindrical cap having a top wall with an internally threaded side wall extending downwardly therefrom;

said top wall of said cap having a circular opening formed therein;

said cap being configured to be secured to the container at the outlet opening thereof;

a dual draw cap adapter mounted on said cap;

said cap adapter including top and bottom housings having upper and lower ends;

said bottom housing having first and second fluid passageways, with upper and lower ends, extending therethrough;

said top housing, having first and second fluid passageways with upper and lower ends, extending therethrough;

said upper end of said first fluid passageway in said bottom housing being in fluid communication with said lower end of said first fluid passageway in said top housing; and said upper end of said second fluid passageway in said bottom housing being in fluid communication with said lower end of said second fluid passageway in said top housing.

5. The cap adapter of claim 4 wherein said lower ends of said first and second passageways in said bottom housing are configured to be placed in fluid communication with said container insert.

6. A dual cap adapter, comprising:

a cylindrical cap having a top wall with an internally threaded side wall extending downwardly therefrom;

said top wall of said cap having a circular opening formed therein;

a dual draw cap adapter mounted on said cap;

said cap adapter including top and bottom housings having upper and lower ends;

said bottom housing having first and second fluid passageways, with upper and lower ends, extending therethrough;

said top housing, having first and second fluid passageways with upper and lower ends, extending therethrough;

said upper end of said first fluid passageway in said bottom housing being in fluid communication with said lower end of said first fluid passageway in said top housing; and said upper end of said second fluid passageway in said bottom housing being in fluid communication with said lower end of said second fluid passageway in said top housing.

* * * * *